US009162265B2

(12) United States Patent
Leppänen

(10) Patent No.: US 9,162,265 B2
(45) Date of Patent: Oct. 20, 2015

(54) METHOD AND APPARATUS FOR MAKING A COLLAR TO THE END OF A PIPE

(75) Inventor: Eero Leppänen, Espoo (FI)

(73) Assignee: T-SOLUTIONS OY, Espoo (FI)

( * ) Notice: Subject to any disclaimer, the term of this patent is extended or adjusted under 35 U.S.C. 154(b) by 365 days.

(21) Appl. No.: 13/696,649

(22) PCT Filed: May 11, 2011

(86) PCT No.: PCT/FI2011/050436

§ 371 (c)(1),
(2), (4) Date: Jan. 8, 2013

(87) PCT Pub. No.: WO2011/141638

PCT Pub. Date: Nov. 17, 2011

(65) Prior Publication Data

US 2013/0133390 A1 May 30, 2013

(30) Foreign Application Priority Data

May 12, 2010 (FI) ..... 20105523

(51) Int. Cl.

| | |
|---|---|
| ***B21D 19/04*** | (2006.01) |
| ***B21D 19/00*** | (2006.01) |
| ***B21B 23/00*** | (2006.01) |

(Continued)

(52) U.S. Cl.

CPC ..... *B21B 23/00* (2013.01); *B21D 19/046* (2013.01); *B21D 39/12* (2013.01); *B21D 19/04* (2013.01)

(58) Field of Classification Search

CPC ..... B21D 19/046; B21D 39/12; B21D 41/00; B21B 23/00

USPC ..... 72/115, 117, 124, 125, 101

See application file for complete search history.

(56) References Cited

U.S. PATENT DOCUMENTS

| | | | |
|---|---|---|---|
| 5,301,414 | A | 4/1994 | Gautheron |
| 5,622,071 | A | 4/1997 | Van Riper et al. |
| 2005/0275223 | A1 | 12/2005 | Kondo |

FOREIGN PATENT DOCUMENTS

| | | | |
|---|---|---|---|
| JP | 3090220 | A | 4/1991 |
| JP | 2000-130650 | A | 5/2000 |

(Continued)

OTHER PUBLICATIONS

Korean Search Report with an English translation for Korean Application No. 10-2012-7029760.

(Continued)

*Primary Examiner* — Livius R Cazan
*Assistant Examiner* — John S Lowe
(74) *Attorney, Agent, or Firm* — Ladas & Parry LLP

(57) ABSTRACT

A method and apparatus for making a collar to the end of a pipe. The apparatus comprises an attachment clamp surrounding the pipe and a body part, connected by hinging to a pivoting cradle having a forming cone, which can enter the end of the pipe. In the method, the forming cone is moved axially and obliquely to the central axis of the pipe, inside the pipe until it contacts the inner surface of the pipe, the forming cone being loaded with the desired load pressure against the inner surface. The forming cone is then pivoted using a pivoting cradle outwards from the central axis of the pipe, around the inner edge of the attachment clamp, and the forming cone and pipe are simultaneously rotated with respect to each other around the central axis of the pipe until the desired collar has formed.

9 Claims, 6 Drawing Sheets

Figure 1:
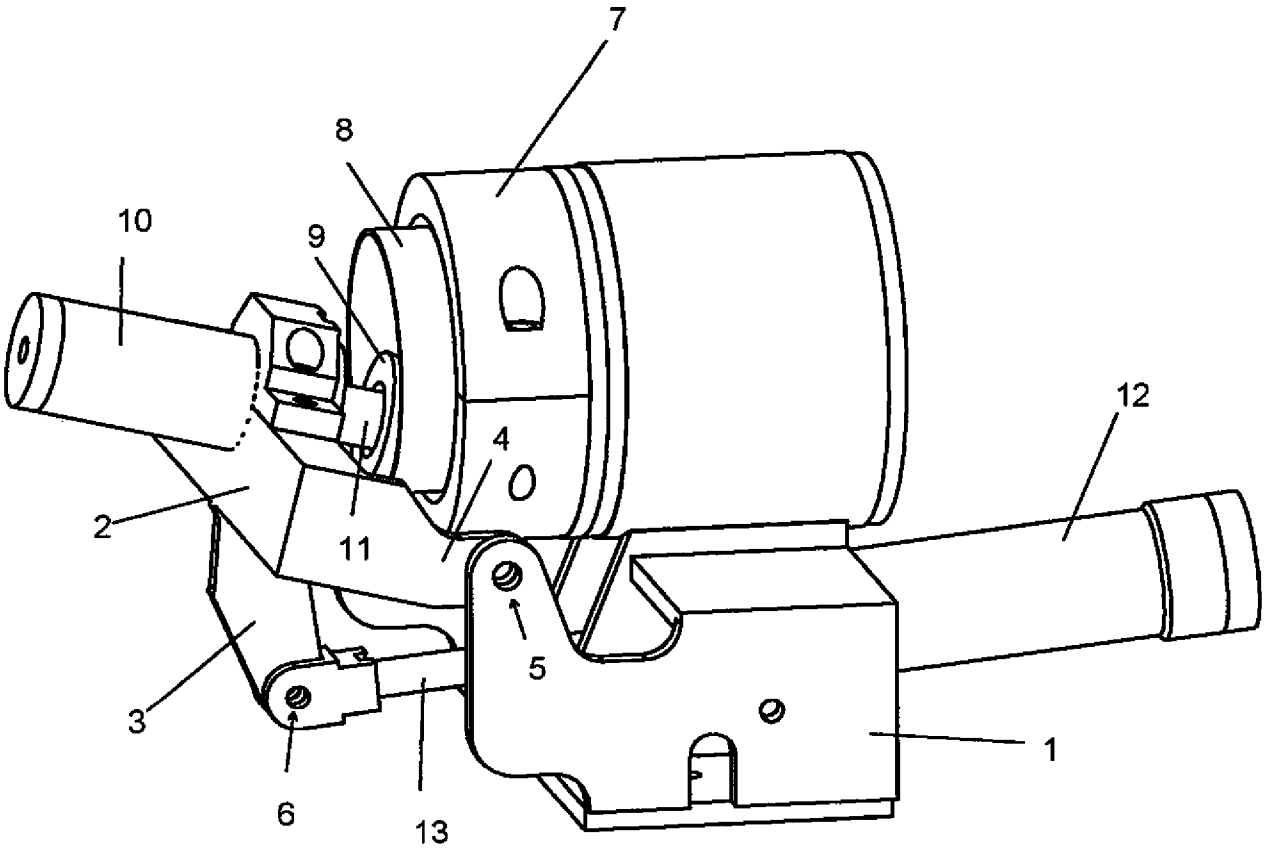

(51) Int. Cl.
*B21B 39/12* (2006.01)
*B21D 39/12* (2006.01)

(56) References Cited

FOREIGN PATENT DOCUMENTS

| | | | | |
|---|---|---|---|---|
| JP | 2001-205367 | A | | 7/2001 |
| JP | 2002-361334 | A | | 12/2002 |
| JP | 2002361334 | A | * | 12/2002 |
| KR | 100929221 | B1 | | 12/2009 |

OTHER PUBLICATIONS

Patent English Abstract of 3090220 A Published Apr. 16, 1991.

Patent English Abstract and Computer-Generated Translation of Japanese 2002-361334 A Published Dec. 17, 2002.

Patent English Abstract and Computer-Generated Translation of Japanese 2001-205367 A Published Jul. 31, 2001.

Patent English Abstract and Computer-Generated Translation of Japanese 2000-130650 A Published May 12, 2000.

* cited by examiner

METHOD AND APPARATUS FOR MAKING A COLLAR TO THE END OF A PIPE

RELATED APPLICATION INFORMATION

This application is a 371 of International Application PCT/FI2011/050436 filed 11 May 2011 entitled "Method And Apparatus For Making A Collar To The End Of A Pipe", which was published in the English language on 17 Nov. 2011, with International Publication Number WO 2011/141638 A1, and which claims priority from Finnish Patent Application No. 20105523 filed on 12 May 2010, the content of which is incorporated herein by reference.

The present invention relates to a method and apparatus for making a collar to the end of a pipe.

To join pipes end to end, flange joints are generally used, which require that there is a collar at the end of each pipe to be joined. To the end of each pipe is typically formed a collar, which is essentially perpendicular to the longitudinal direction of the pipe and behind the collars is provided flanges, which are tightened with screws and nuts against each other. There are also such joining solutions, where the collar is in a different angular position with respect to the longitudinal direction of the pipe, for example, at a 37° angle.

Collars can be made in various ways. One way is to weld an extension which already includes a collar to the pipe. Another way is to provide the pipes with collars already at the factory before bringing them to the installation site. For this purpose are available different types of collar making apparatuses. These types of collar making apparatuses are usually large and heavy and cannot, in practice, be taken to the installation site.

The aim of the present invention is to provide an improved method and apparatus for making collars for metal pipes at the installation site, in which case fitting the pipes to their correct locations would be significantly easier and the collar making could, in addition, be done on already installed pipes, for example, when repairing a damaged pipe section which can be removed and replaced by installing a new pipe section reliably without having to unnecessarily demolish undamaged pipe sections. A further aim is to reduce the need to transport pipes back and forth to the workshop, for example, due to dimensional errors.

To achieve this aim, the method according to the invention is characterised in that, in the method, a forming cone is moved by an axial movement, obliquely to the central axis of the pipe, inside the pipe until the forming cone makes contact with the inner surface of the pipe, making essentially linear contact with the inner surface of the pipe, and the forming cone is loaded with the desired load pressure against the inner surface, the forming cone is then pivoted by means of a pivoting cradle outwards from the central axis of the pipe, around the inner edge of the attachment clamp, and the forming cone and pipe are at the same time made to rotate with respect to each other around the central axis of the pipe, and the said pivoting and rotating movements are continued until the desired collar has formed at the end of the pipe, against the face of the attachment clamp, which acts as a back stop for the collar.

The apparatus according to the invention is, on the other hand, characterised in that the body part is connected to the attachment clamp in such a way that the body part and the pipe to which a collar is to be formed attached to the attachment clamp will be able to rotate with respect to one another around the longitudinal axis of the pipe; that the pivoting cradle is made into the shape of a fork, comprising a pivoting cradle part to which the forming cone is connected in such a way that the forming cone can be moved towards the interior of the pipe by an axial movement, and that the pivoting cradle part is equipped with swinging arms which are pivoted on the body part in such a way that the pivots are located at a point outside the pipe, while the body part is connected to the attachment clamp.

Preferred embodiments of the invention are described in the dependent claims.

The apparatus according to the invention can be realised as a light and small apparatus which is easy to take to the installation site and which can be used for making collars for both already installed pipes and loose pipes.

Figure 2:
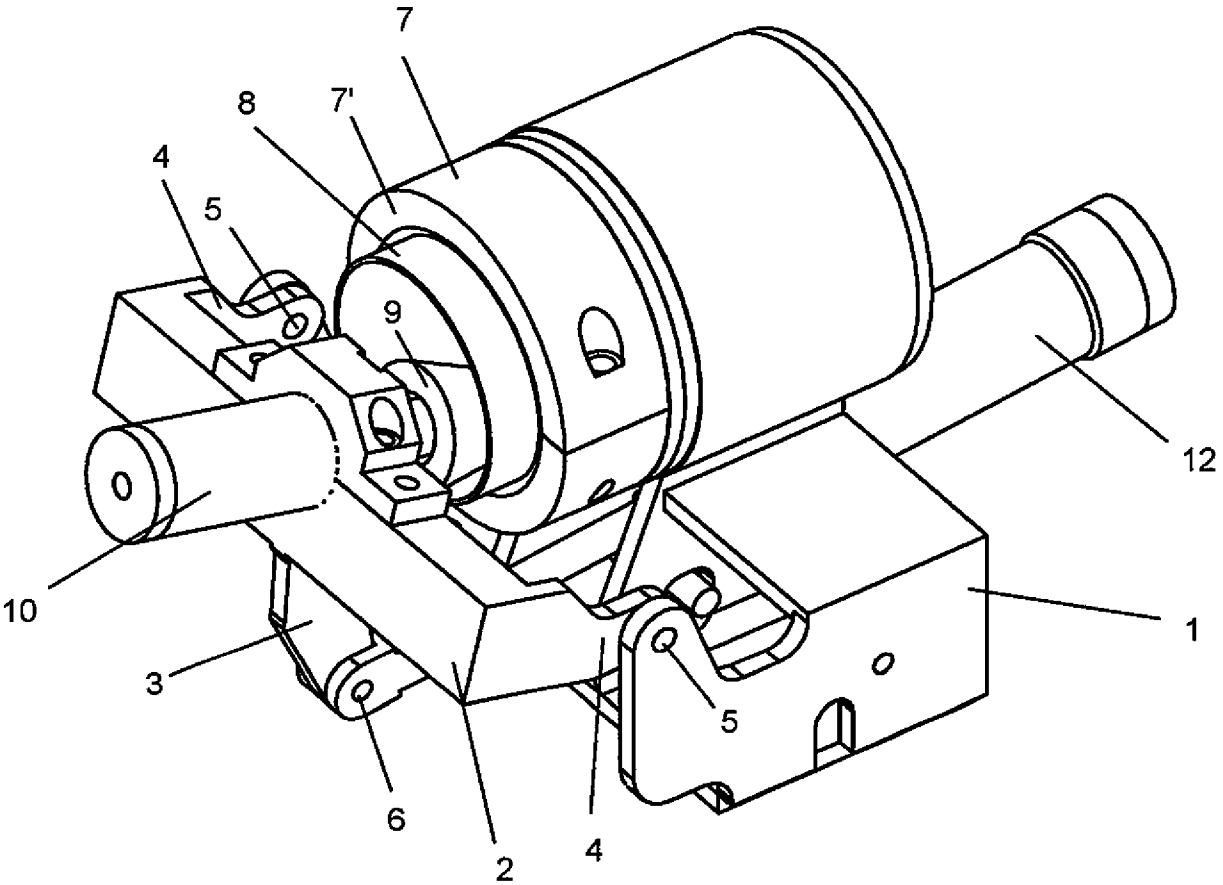
Figure 3:
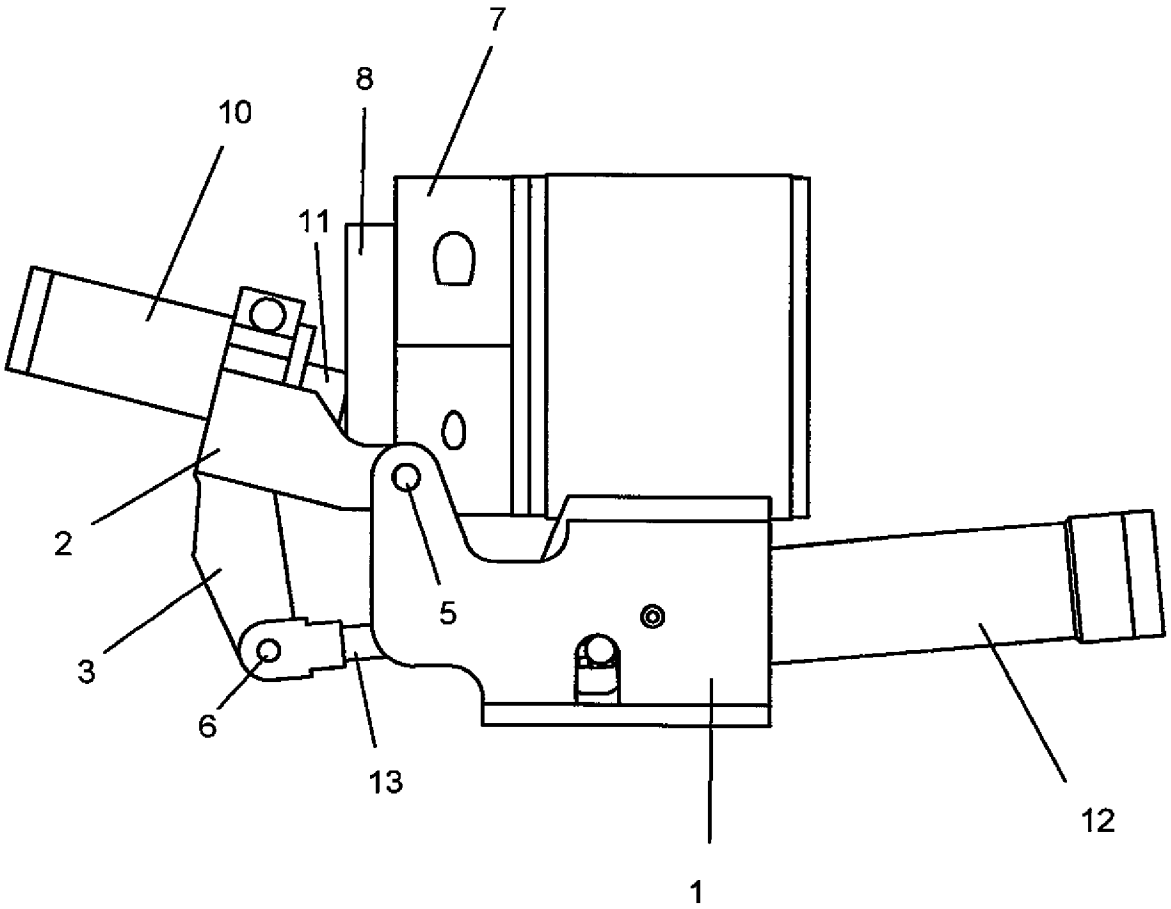
Figure 4:
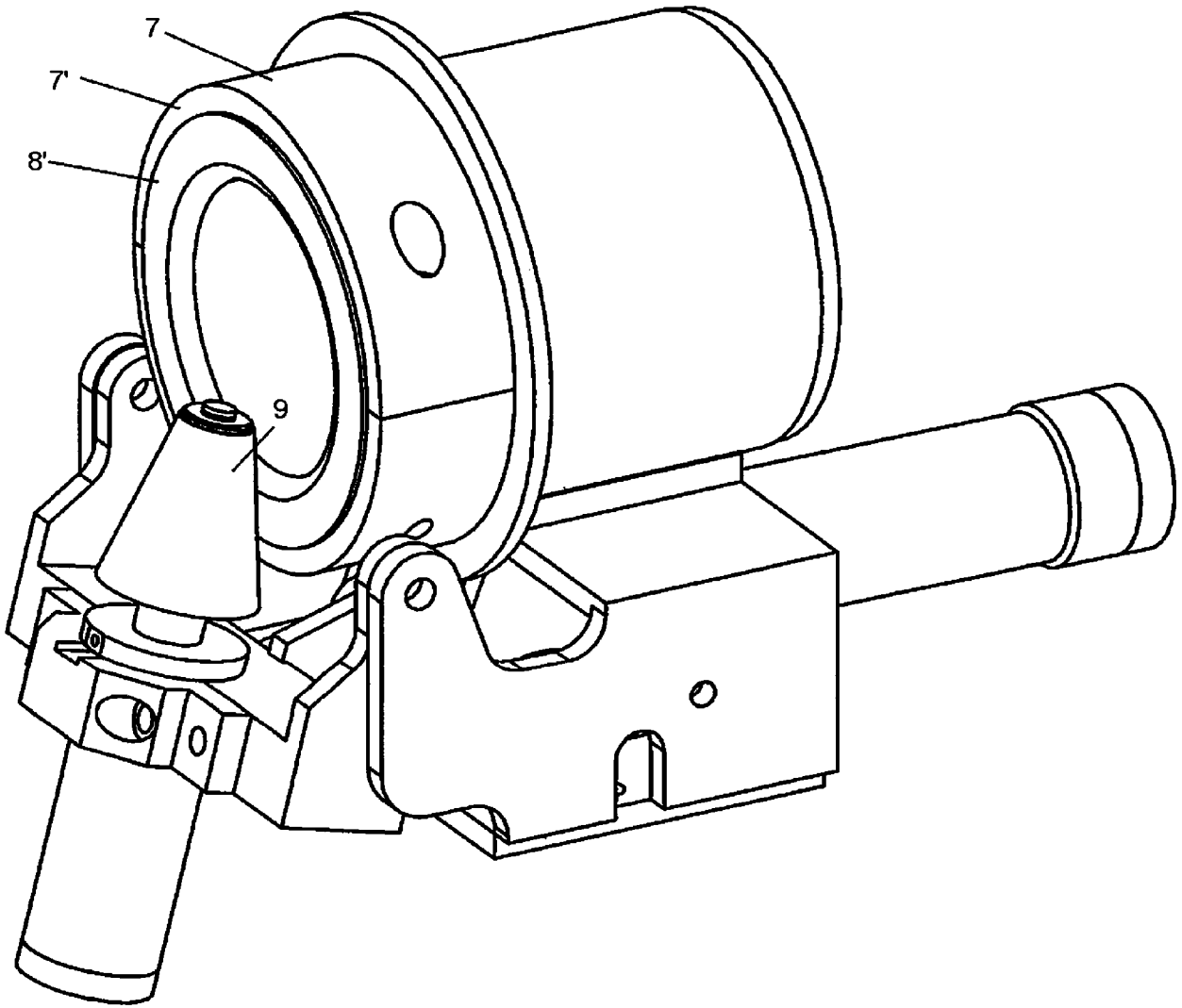
Figure 5:
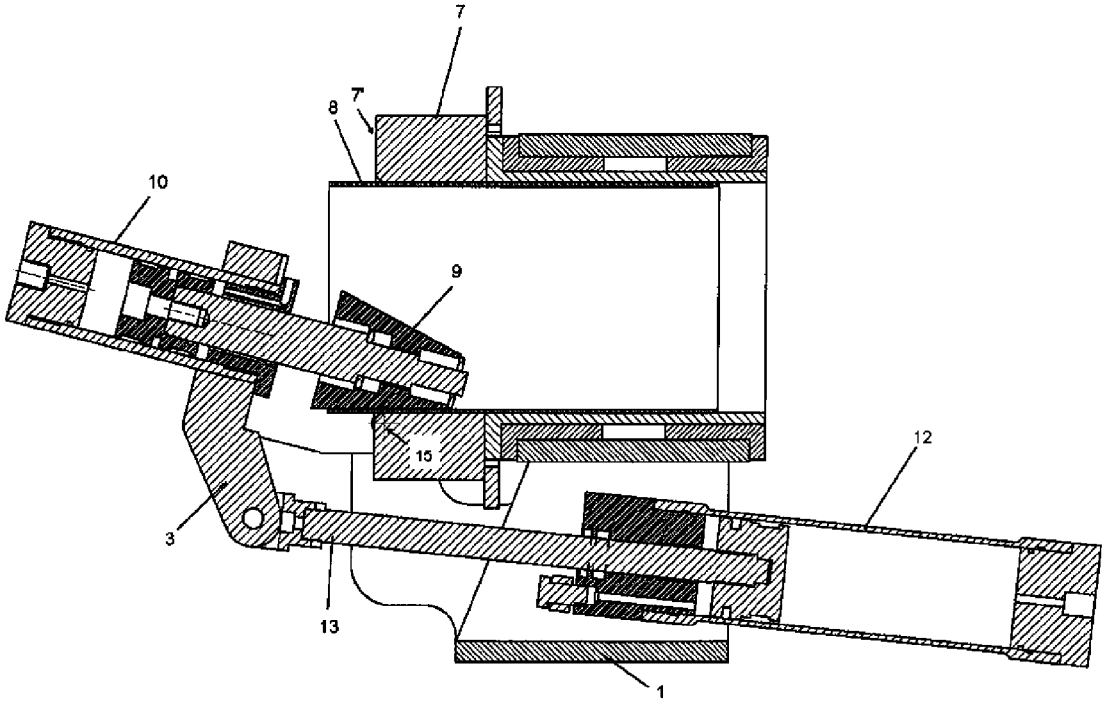
Figure 6:
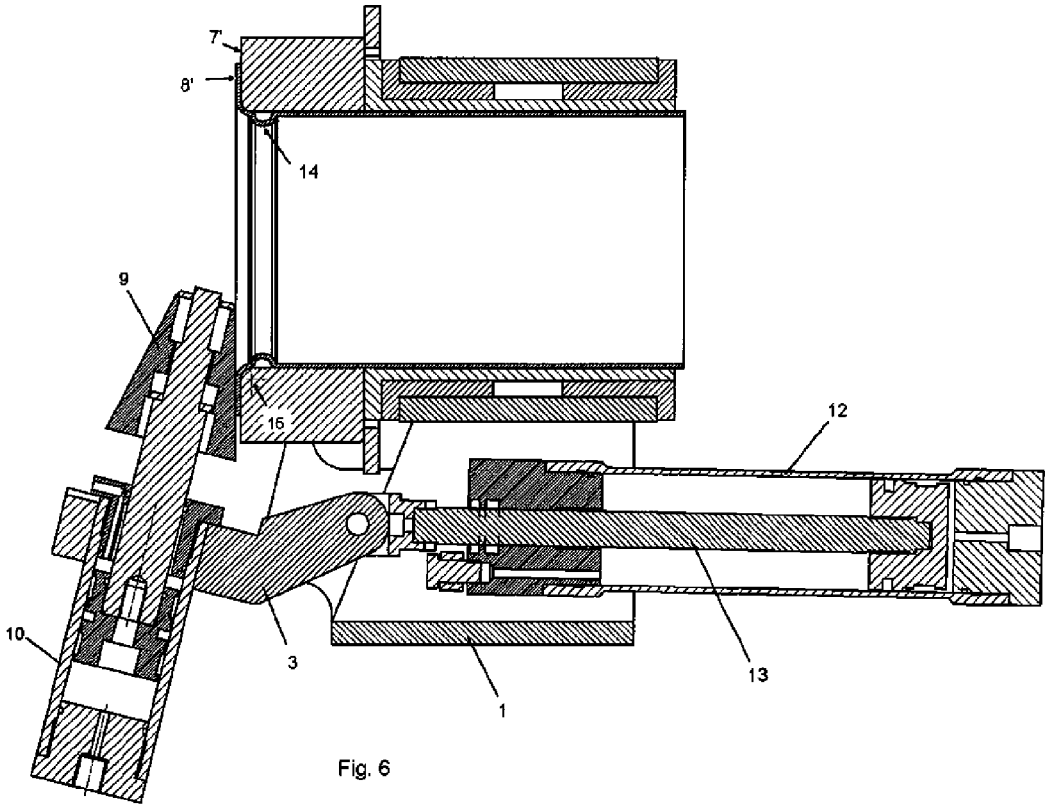
Figure 7:
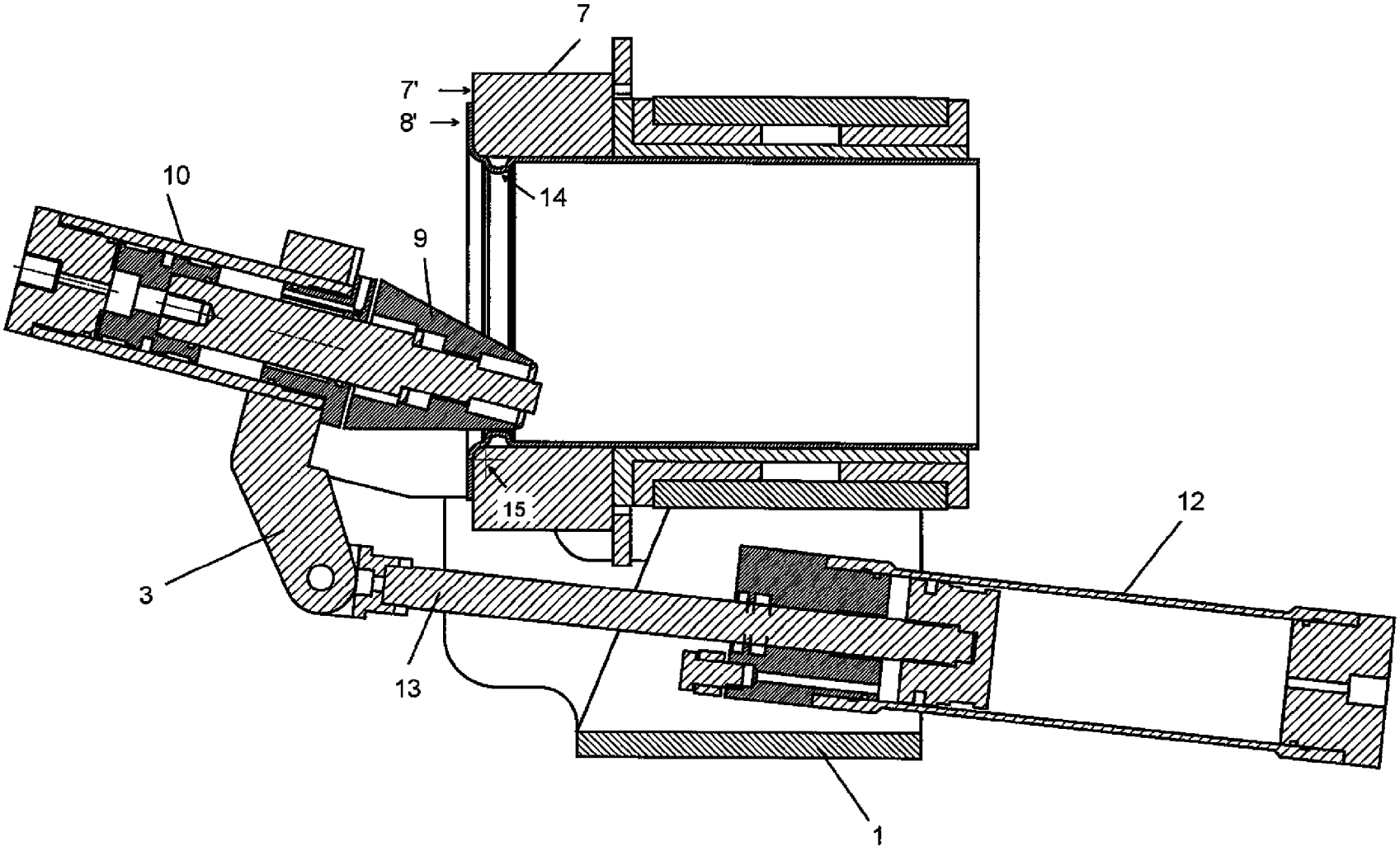

The invention is described in greater detail in the following, with reference to the accompanying drawings, in which:

FIGS. 1-3 show an embodiment of the apparatus according to the invention at the initial stage of collar making from different view angles, FIG. 4 shows the apparatus of FIGS. 1-3 as a perspective view at the end of the collar making stage, and FIGS. 5-7 show sectional views at the initial stage, the final stage and the beginning of the necking repair stage, in respective order.

The collar making apparatus according to an embodiment of the invention shown in the Figures comprises a body part 1, to which a pivoting cradle is connected in a pivoted manner. The pivoting cradle is made into fork-like form comprising a pivoting cradle 2 and swinging arms which are pivoted on the body part 1 at pivots 5. In the pivoting cradle part 2 is provided a hydraulic cylinder 10, on the piston rod 11 of which is connected a forming cone 9. By means of the hydraulic cylinder, the forming cone can be moved inside the pipe 8 to which a collar is to be formed by an axial movement. The apparatus also includes an attachment clamp 7, the face 7' of which forms a back stop for the collar 8' being formed. The body part 1 is connected to the attachment clamp 7 in such a way that the body part and the pipe 8 to which a collar is to be formed, which is attached to the attachment clamp, are able to rotate with respect to one another around the longitudinal axis of the pipe. The connection can be carried out, for example, by providing the periphery of the attachment clamp with a toothed rim and by providing the body part with a cogwheel cooperating with the toothed rim (the connecting means are not shown in the drawings).

The pivots 5 between the pivoting cradle and the body part are located at a point outside the pipe when the body part is connected to the attachment clamp in such a way that the axis of rotation of the pivoting cradle determined by them runs in the direction of the tangent of the pipe 8, essentially through the centre 15 of the imaginary circle (shown in FIGS. 5-7) determined by the corner radius between the collar 7' to be formed and the inner surface of the pipe 8. The forming cone 9 will then automatically settle to the correct point, irrespective of the thickness of the pipe wall.

The pivoting cradle is connected by an articulated joint 6 to the piston rod 13 of the hydraulic cylinder 12 provided on the body part 1 in order to perform the pivoting movement. In the embodiment shown, the face 7' of the attachment clamp 7 is essentially perpendicular to the central axis of the pipe 8 in order to form an essentially rectangular collar at the end of the pipe. The face can also be formed into a different angular position, as required by the manner of connecting the pipes.

When the apparatus is used, the attachment clamp 7 is positioned at such distance from the end of the pipe which corresponds to the width of the collar 8' to be formed around the pipe 8. The body part 1 is connected functionally to the attachment clamp 7 and the forming cone 9 is moved by an axial movement, obliquely to the central axis of the pipe 8, inside the pipe, until the forming cone 9 makes contact with the inner surface of the pipe, making essentially linear contact with the inner surface of the pipe. This contact line extends essentially at least to the inner edge of the attachment clamp. The forming cone 9 is then loaded with the desired load pressure against the inner surface and the forming cone 9 is pivoted by means of a pivoting cradle outwards from the central axis of the pipe 8, around the inner edge of the attachment clamp 7 and the forming cone 9 and the pipe 8 are at the same time made to rotate with respect to each other around the central axis of the pipe. The said pivoting and rotating movement is continued until the desired collar 8' has formed against the face 7' of the attachment clamp, which acts as a back stop for the collar.

A necking 14 (FIG. 6) directed towards the central axis of the pipe, which has possibly formed during the forming of the collar 8', can be removed by driving the forming cone 9 inside the pipe again, until it contacts the ridge (FIG. 7) of the necking, after which the forming cone 9 is loaded with the desired load pressure against the inner surface and the forming operation is repeated, whereby the necking can be removed. The possible formation of the necking depends on the pipe material and the material thickness, among other things.

The invention claimed is:

1. A method for making a collar to the end of a pipe (8), comprising: positioning a collar making apparatus which comprises an attachment clamp (7) surrounding the pipe (8), at a distance from the end of the pipe which corresponds to the width of the collar to be formed, the collar making apparatus comprising a body part (1), to which is connected by hinging a pivoting cradle in the shape of a fork and equipped with swinging arms (4) which are pivoted on the body part (1) in such a way that the pivots (5) are located at a point outside the pipe, the cradle being provided with a forming cone (9), which forming cone (9) can be taken inside the end of the pipe (8) to which the collar is to be formed; moving the forming cone (9) by an axial movement, obliquely to the central axis of the pipe (8), inside the pipe until the forming cone (9) makes contact with the inner surface of the pipe, making essentially linear contact with the inner surface of the pipe, and the forming cone (9) is loaded with the desired load pressure against the inner surface; then, pivoting, the forming cone by means of the pivoting cradle outwards from the central axis of the pipe (8), around the inner edge of the attachment clamp (7), and at the same time making the forming cone (9) and pipe (8) rotate with respect to each other around the central axis of the pipe; and, continuing the pivoting and rotating movements until the desired collar (8') has formed against the face (7') of the attachment clamp at the end of the pipe, which acts as a back stop for the collar, wherein the body part (1) is connected to the attachment clamp (7) in such a way that the axis of rotation of the pivoting cradle determined by the pivots (5) runs in the direction of the tangent of the pipe (8), through the center of an imaginary circle determined by the corner radius between the collar (8') to be formed and the inner surface of the pipe.

2. A method as claimed in claim 1, comprising removing a necking (14) directed towards the central axis of the pipe, which has formed during the forming of the collar (8'), by driving the forming cone (9) inside the pipe again, until it meets a ridge of the necking, and then loading the forming cone (9) with the desired load pressure against the inner surface and repeating the forming operation, whereby the necking can be removed.

3. An apparatus for making a collar to the end of a pipe (8), which apparatus comprises a body part (1), a pivoting cradle connected to the body part in a pivoted manner, a forming cone (9) connected to the pivoting cradle, the forming cone being arranged to be taken inside the pipe (8) to which a collar is to be formed, and an attachment clamp (7) surrounding the pipe, located at a distance corresponding to the width of the collar to be formed from the end of the pipe to which a collar is to be formed, a face (7') of the attachment clamp forming a back stop for the collar being formed, wherein: the body part (1) is connected to the attachment clamp (7) in such a way that the body part and the pipe (8) to which the collar is to be formed, which is attached to the attachment clamp, are able to rotate with respect to one another around the longitudinal axis of the pipe; the pivoting cradle is made into the shape of a fork, comprising a pivoting cradle part (2) to which the forming cone (9) is connected in such a way that the forming cone can be moved towards the interior of the pipe (8) by an axial movement; and, the pivoting cradle part (2) is equipped with swinging arms (4) which are pivoted on the body part (1) in such a way that the pivots (5) are located at a point outside the pipe, while the body part is connected to the attachment clamp, wherein the pivots (5) are located in such a way that the axis of rotation of the pivoting cradle determined by them runs in the direction of the tangent of the pipe (8), essentially through the center of an imaginary circle determined by the corner radius between the collar (8') to be formed and the inner surface of the pipe (8).

4. An apparatus as claimed in claim 3, wherein the rotation between the body (1) and the attachment clamp (7) is implemented by a toothing connection.

5. An apparatus as claimed in claim 3, wherein the forming cone (9) is connected to a hydraulic cylinder (10) provided in the pivoting cradle part (2) in order to perform the axial movement of the forming cone.

6. An apparatus as claimed in claim 3, wherein the pivoting cradle is connected by an articulated joint (6) to a hydraulic cylinder (12) provided on the body part (1) in order to perform the pivoting movement of the pivoting cradle.

7. An apparatus as claimed in claim 3, wherein the face (7') of the attachment clamp (7) is perpendicular to the central axis of the pipe (8) in order to form an essentially rectangular collar at the end of the pipe.

8. A method for making a collar to an end of a pipe, comprising the steps of:

(a) providing the apparatus of claim 3;

(b) positioning the apparatus around the pipe at a distance from the end of the pipe which corresponds to the width of the collar to be formed;

(c) moving the forming cone by an axial movement, obliquely to a central axis of the pipe, inside the pipe until the forming cone makes contact with an inner surface of the pipe, and loading the forming cone with a desired load pressure against the inner surface;

(d) pivoting the forming cone by means of the pivoting cradle outwards from the central axis of the pipe, around an inner edge of the attachment clamp and at the same time making the forming cone and pipe rotate with respect to each other around the central axis of the pipe;

(e) continuing to pivot the forming cone and to rotate the forming cone and pipe with respect to each other until the collar has formed against the face of the attachment clamp at the end of the pipe.

9. The method according to claim 8, further comprising the step of:

(f) removing a necking directed towards the central axis of the pipe that has formed during the making of the collar by driving the forming cone inside the pipe until it meets a ridge of the necking; and then (g) pressing the forming cone against the inner surface with a pressure and repeating the forming operation, the pressure being sufficient to remove the necking.

* * * * *